US005519289A

United States Patent [19]

Katyl et al.

[11] Patent Number: 5,519,289

[45] Date of Patent: May 21, 1996

[54] ELECTRONIC BALLAST WITH LAMP CURRENT CORRECTION CIRCUIT

[75] Inventors: Robert H. Katyl, Vestal; Robert M. Murcko, Binghamton, both of N.Y.

[73] Assignee: JRS Technology Associates, Inc., Owego, N.Y.

[21] Appl. No.: 335,528

[22] Filed: Nov. 7, 1994

[51] Int. Cl.[6] ..... H05B 37/02

[52] U.S. Cl. ..... 315/224; 315/247; 315/209 R; 315/244; 315/291; 315/307; 315/DIG. 7

[58] Field of Search ..... 315/247, 209 R, 315/219, 224, 244, 291, 307, 309, DIG. 2, DIG. 5, DIG. 7

[56] References Cited

U.S. PATENT DOCUMENTS

| | | | |
|---|---|---|---|
| 3,953,768 | 4/1976 | Meredith et al. | 317/31 |
| 4,277,726 | 7/1981 | Burke | 315/98 |
| 4,463,286 | 7/1984 | Justice | 315/219 |
| 4,766,353 | 8/1988 | Burgess | 315/324 |
| 4,802,073 | 1/1989 | Plumly | 315/362 X |
| 5,032,767 | 7/1991 | Erhardt et al. | 315/219 |
| 5,063,331 | 11/1991 | Nostwick | 315/219 |
| 5,192,897 | 3/1993 | Vossough et al. | 315/308 |
| 5,204,587 | 4/1993 | Mortimer et al. | 315/308 |
| 5,287,040 | 4/1994 | Lestician | 315/291 |
| 5,363,020 | 11/1994 | Chen et al. | 315/209 R |
| 5,381,077 | 1/1995 | McGuire | 315/247 |
| 5,394,064 | 2/1995 | Ranganath et al. | 315/209 R |

OTHER PUBLICATIONS

"Transistor Sine–Wave LC Oscillators" by P. J. Baxandall, Feb. 1960.

"Practical Design Problems in Transistor D.C./D.C. Convertors and D.C./A.C. Inverters" by T. D. Towers, Apr. 1960.

"Motion and Proximity Detectors" by Rudolf F. Graf and William Sheets, 1992.

*Primary Examiner*—Robert Pascal
*Assistant Examiner*—Haissa Philogene
*Attorney, Agent, or Firm*—Salzman & Levy

[57] ABSTRACT

The present invention features a gas discharge lamp electronic ballast that uses a frequency-dependent control circuit. The lamps are all energized by means of a single electronic ballast, including an electronically regulated power supply, a power oscillator/driver circuit, an output coupling circuit and a feedback circuit that provides frequency-to-voltage conversion for controlling the output voltage of the power supply. In this way, constant lamp current is maintained, regardless of the number of lamps connected. Since the remaining lamps are operated at their specified, correct lamp current, lamp life is preserved. Another feature of the circuit is its ability to dim the lamp output continuously over a limited range to reduce energy usable in circumstances in which full lamp illumination is not required. Such dimming can be controlled by a suitable external control signal such as from a potentiometer, switch, light monitoring device or a motion detector.

24 Claims, 9 Drawing Sheets

ELECTRONIC BALLAST WITH LAMP CURRENT CORRECTION CIRCUIT

FIELD OF THE INVENTION

The present invention pertains to ballasts for gas discharge lamps and, more particularly, to electronic ballasts with frequency-dependent lamp current correction circuits.

1. Description of Related Art

Some ballasts provide lamp current control for the purposes of dimming or maintaining the constancy of current through temperature or voltage changes. U.S. Pat. No. 5,287,040 (issued Feb. 15, 1994, to LESTICIAN), entitled "Variable Control, Current Sensing Ballast", describes a MOSFET circuit with pulse width modulation control for dimming. That circuit uses a transformer design which allows different lamp loads to be driven without there being the need for component changes. Using multiple output transformers, this design has a lamp current sensing scheme that decreases drive, when a lamp burns out or is removed. Such an effect is accomplished by change in pulse width modulation, controlled by rectified lamp current feedback.

U.S. Pat. No. 5,204,587 (issued Apr. 20, 1993, to MORTIMER and BURKE), entitled "Fluorescent Lamp Power Control", discloses dimming by power control through a circuit that senses lamp power by computing the product of the voltage and current, which then provides input to an inverter.

U.S. Pat. No. 5,066,894 (issued Nov. 19, 1991, to KLIER), entitled "Electronic Ballast", discloses a ballast circuit which includes a feedback circuit to control lamp current at low dimming levels and is based on sensing lamp resistance using a resistance divider across the lamp circuit. This patent is based on the concept that lamp resistance increases at low current levels, when the discharge is nearly extinguished. Also included are means for injecting low-frequency AC across the lamp for control purposes. Frequency-dependent filter elements in the circuit extract this control (tagging) signal.

U.S. Pat. No. 5,063,331 (issued Nov. 5, 1991, to NOSTWICK), entitled "High Frequency-Oscillator Inverter Circuit for Discharge Lamps", discloses a circuit that uses a boost transformer in series with secondary lamp current, in conjunction with a power rectifier bridge, to correct power line distortion and power factor. The circuit does not correct for the differences in current that occur when a different number of lamps are connected.

U.S. Pat No. 5,032,767 (issued Jul. 16, 1991, to ERHARDT, et al.), entitled "High Frequency Oscillator-Inverter with Improved Regenerative Power Supply", describes a modification of conventional, bipolar, Class D inverters. It includes an energy-recovery winding on the feed choke to an output transformer. This circuit protects the drive transistors at start-up from the voltage spikes that result from a parasitic mode of oscillation that sometimes occurs. In this mode, two drive transistors operate in parallel (instead of push-pull); large, destructive voltage transients can result.

U.S. Pat. No. 4,766,353 (issued Aug. 23, 1988, to BURGESS), entitled "Lamp Switching Circuit and Method", discusses the problem of shortened lamp life when one lamp is removed from a multiple-lamp fixture. Phantom lamps (i e., "dummy" lamps that contain a capacitor only) are discussed as is a latching relay system for switching lamps and ballasts to accomplish so-called step-dimming.

U.S. Pat. No. 4,802,073 (issued Jan 31, 1989, to PLUMLY), entitled "Lighting Level Control Apparatus for Fluorescent Lighting Installations", teaches a step dimming approach, in which latching relays switch in ballast capacitors to vary the lamp current.

U.S. Pat. No. 4,463,286 (issued Jul. 31, 1984, to JUSTICE), entitled "Lightweight Electronic Ballast for Fluorescent Lamps", discloses a bipolar push-pull power oscillator with the transistor bases self-biased through a feedback winding. The lamps are series connected directly across the primary of the output transformer.

U.S. Pat. No. 4,277,726 (issued Jul. 7, 1981, to BURKE, entitled "Solid-State Ballast for Rapid-Start Type Fluorescent Lamps", discloses a bipolar inverter A delayed control of the base drive bias voltage is provided to soft-start rapid-start lamps. Lamps are connected in parallel, but no power factor correction is provided, nor is provision made for correcting the lamp current when a lamp is removed.

U.S. Pat. No. 3,973,165 (issued Aug. 3, 1976, to HESTER), teaches the use of the basic Class D inverter circuit without either power factor correction or lamp removal correction.

U.S. Pat. No. 3,953,768 (issued Apr. 27, 1976, to MEREDITH, et al, entitled "Portable Fluorescent Lamp and Inverter Therefor", discloses a pnp, bipolar, self-starting Hartley-type oscillator as an inverter with a series transistor, linear current regulation circuit and parallel connection of the lamps through ballast capacitors.

BACKGROUND OF THE INVENTION

With an increased emphasis on energy conservation today, the efficiency of lighting systems is receiving more attention. Gas discharge lamps, such as fluorescent lamps, can be quite efficient. These lamps work most efficiently when energized by high-frequency currents in the 25–100 kHz region. Circuits that produce such excitation are known in the art as "electronic ballasts", in order to distinguish them from conventional, inductive ballasts.

It is deemed desirable to operate fluorescent lamps at a preferred current level. This level is typically chosen to be the value that produces a fraction (usually 87.5%) of the light output of a standardized test environment. This test environment is specified in ANSI standards for the fluorescent lamp. When operated at the preferred current, the correct value of light output is obtained; long operating life of the lamp results; and the light output has the correct color index.

Ballasts provide several functions. Ballasts provide sufficiently high voltage to commence glow discharge within lamps. During the operation of lamps, ballasts provide a source impedance that overrides the negative resistance property of the glow discharge. A stable operating point results. For rapid-start and preheat lamps, ballasts also provide filament heater current. The most desirable ballasts provide these functions at low cost with high energy efficiency, reliability and safety, while minimizing distortion of AC line current and emission of radio frequency energy.

The user of a lighting fixture having multiple gas discharge lamps may desire to operate the fixture with fewer than the maximum possible number of lamps. This can be accomplished by installing fewer lamps in the lighting fixture than its maximum lamp capacity. Under these conditions, it is desirable to operate the installed lamps at their appropriate and correct current. As mentioned, maintaining lamp current at the correct value is an important consideration in preserving lamp life. For ballasts with lamps connected in parallel, however, removing one or more lamps from the fixture usually results in an increase in operating frequency, as well as a significant increase in lamp current. Heretofore, lamp current feedback has been used to correct for increased lamp current, but this corrective ability is not employed in most ballasts.

Lamps connected in parallel (i.e., a series network of a lamp and its ballast capacitor, connected in parallel with other such networks across the output of the ballast's power oscillator), represent a common type of connection for fixtures having three or four lamps; such an arrangement is even used with certain two-lamp fixtures. A problem with lamp current arises, however, because the ballast capacitors are coupled into the resonant circuit. Thus the ballast capacitors themselves partially determine the operating frequency. As lamps are removed or disconnected, the resonating capacitance decreases, which increases the operating frequency. However, the circuit voltage does not significantly change. With the increased operating frequency, the reactance of the ballast capacitors decreases. Since the ballast capacitors provide the main impedance to current flow, the lamp current also increases.

It would be advantageous to provide an electronic ballast to maintain appropriate and correct lamp current, regardless of the number of lamps connected to a given lighting fixture.

It would also be advantageous to provide a single electronic ballast for energizing and controlling a plurality of lamps.

It would be further advantageous to provide such an electronic ballast that uses a self-oscillating inverter, in which the lamps may be connected in a parallel.

It would be still further advantageous to provide such an electronic ballast that would incorporate a frequency-dependent control circuit.

SUMMARY OF THE INVENTION

In accordance with the present invention, there is provided an electronic ballast for use with lighting fixtures that contain a plurality of gas discharge lamps. The ballast uses a frequency-dependent control circuit to maintain the correct lamp current, regardless of the number of lamps connected. The lamps are all energized by means of the single inventive, electronic ballast. The ballast corrects the lamp current in situations in which fewer than the maximum allowable number of lamps are installed in a fixture, or in which certain lamps are intentionally disconnected for the purposes of dimming the fixture light output in steps. Since capacitors provide the main impedance to current flow, the lamp current increases under these circumstances. A switch-mode type of power supply circuit or other similar regulating circuit is used to provide power to the lamp driving circuitry, while also providing a correction to the power factor of the AC mains supplied power. The high-frequency lamp current is provided by a Class D, push-pull, self-oscillating inverter. Another feature of the circuit is its ability to continuously dim the lamp output over a limited range in order to reduce energy usage in the circumstances in which full lamp illumination is not required. Such dimming can be controlled by a suitable external control signal or by input from a light-monitoring photo device.

BRIEF DESCRIPTION OF THE DRAWINGS

A complete understanding of the present invention may be obtained by reference to the accompanying drawings, when taken in conjunction with the detailed description thereof and in which.

DESCRIPTION OF THE PREFERRED EMBODIMENT

The present invention is an electronic ballast for use with lighting fixtures that contain a plurality of gas discharge lamps. The ballast uses a frequency-dependent control circuit in order to maintain the correct lamp current, regardless of the number of lamps connected.

Figure 1:
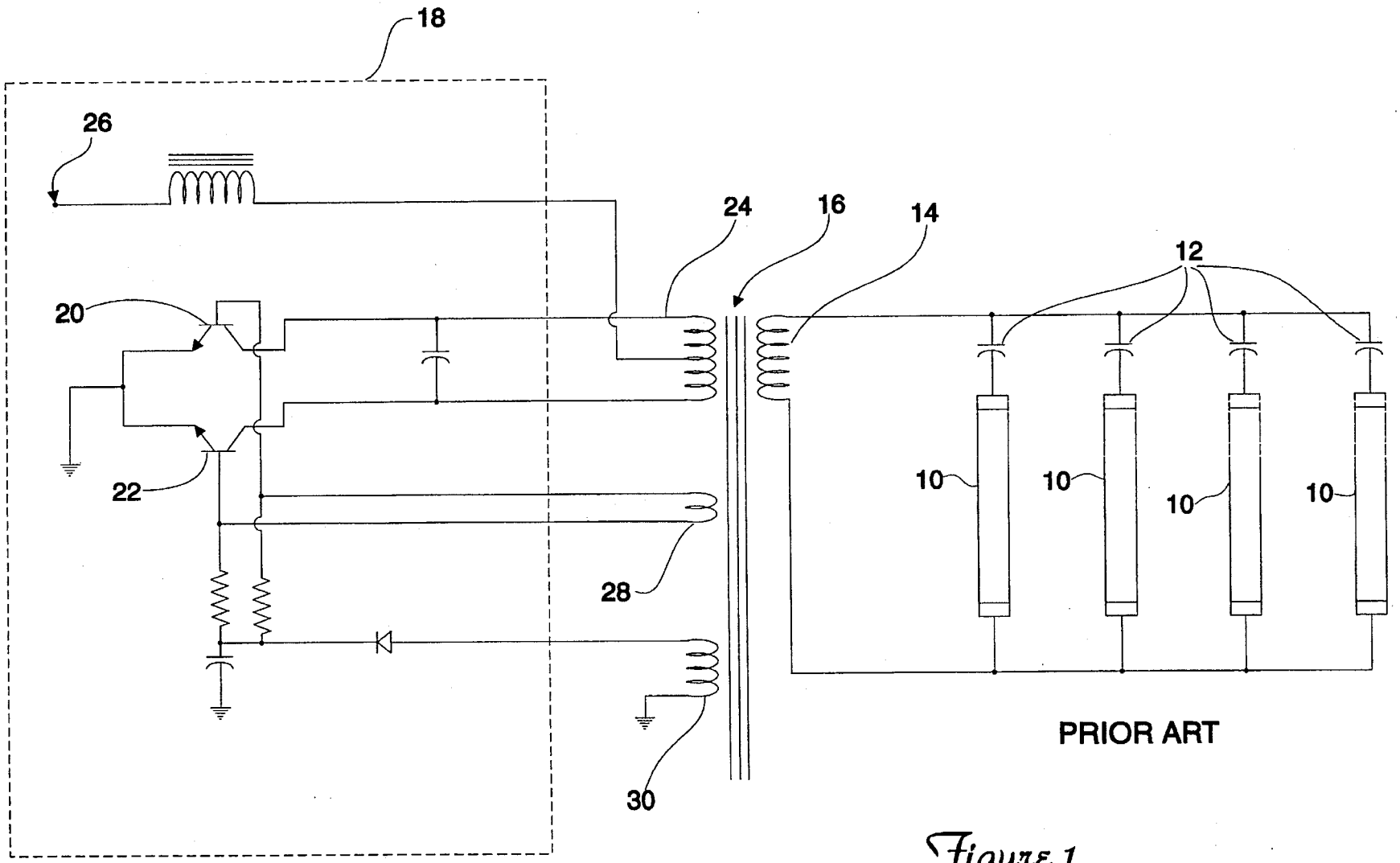
PRIOR ART Figure 1
FIG. 1 is a schematic diagram of an electronic ballast circuit connected to a plurality of gas discharge lamps, with the lamps and their respective capacitors being connected in parallel across the output of the ballast's power oscillator, in accordance with the prior art.

Referring now to FIG. 1, there is shown a conventional, bipolar, Class D inverter, which is well known to those skilled in the art. Each of a plurality of discharge lamps 10 is connected to a respective ballasting capacitor 12. The parallel combinations of lamps 10 and capacitors 12 are connected to the secondary winding 14 of an output transformer 16. A Class D oscillator circuit, comprising bipolar transistors 20 and 22, is shown generally at reference numeral 18.

The output of oscillator circuit 18 is connected to the primary winding 24 of output transformer 16. Feedback windings 28 and 30 of transformer 16, in cooperation with appropriately selected resistors and capacitors, allow the DC voltage applied at terminal 26 to cause the circuit 18 to begin and to sustain oscillation at a predetermined frequency. The oscillation frequency is a function of the circuit elements and their values. The AC voltage at secondary winding 14 (determined by the turns ratio of transformer 16) is applied to the lamps 10 through the capacitors 12.

Figure 2:
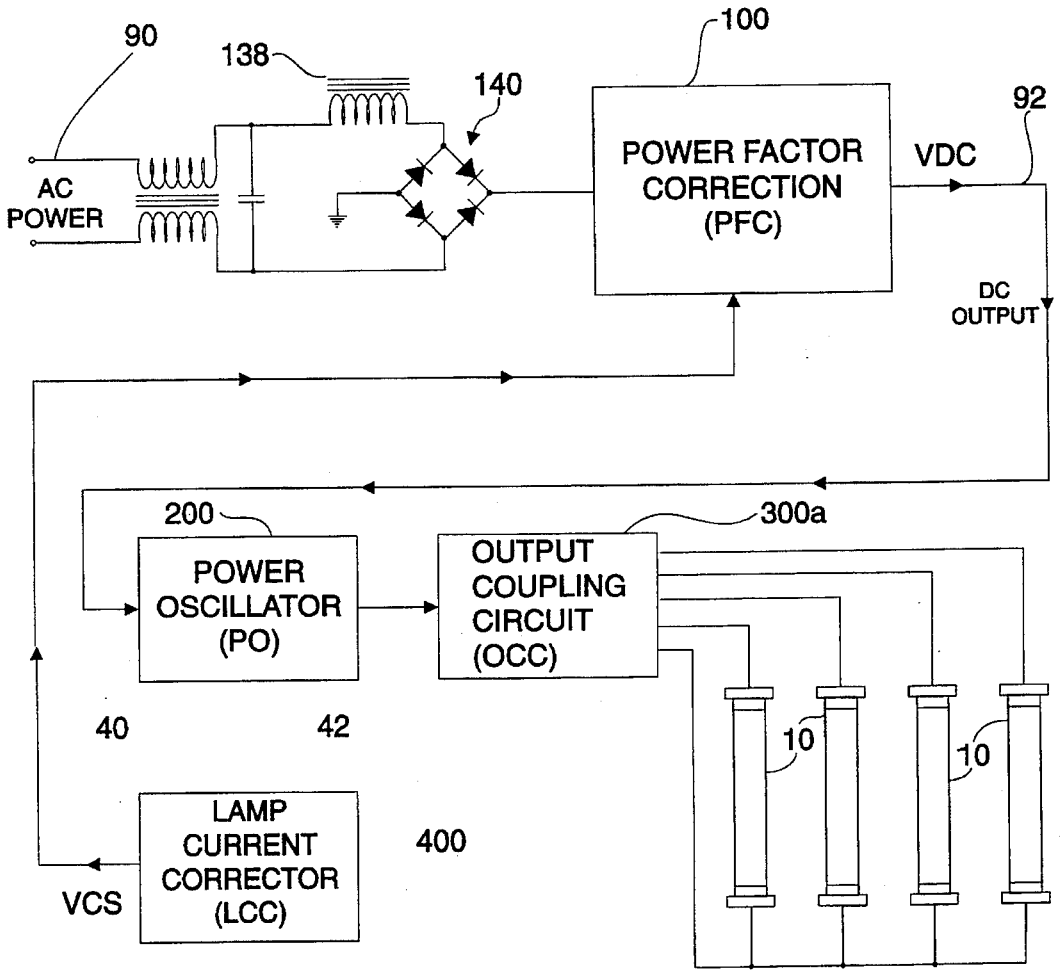
FIG. 2 is a block diagram of the electronic ballast of the present invention.

Referring now also to FIG. 2, there is shown a block diagram of the electronic ballast of the present invention. The ballast has three main circuit sections: a power factor correction (PFC) circuit 100, which converts the incoming AC power 90 into regulated DC power 92, while maintaining essentially a unity power factor (i.e., it appears as a resistive-like load to the AC supply); a power oscillator (PO) 200, which converts DC power 92 to the high-frequency sinusoidal energy required to drive the lamps 10; and an output coupling circuit (OCC) 300*a*, used to couple the high-frequency into the lamps 10.

The final, main circuit section of the electronic ballast is a lamp current correction (LCC) circuit 400, in which sampled drive voltage undergoes frequency-to-voltage conversion in order to create a voltage control signal (VCS) 40. This voltage control signal 40 is used to regulate the DC voltage level to the value required to produce the correct lamp current.

Figure 3:
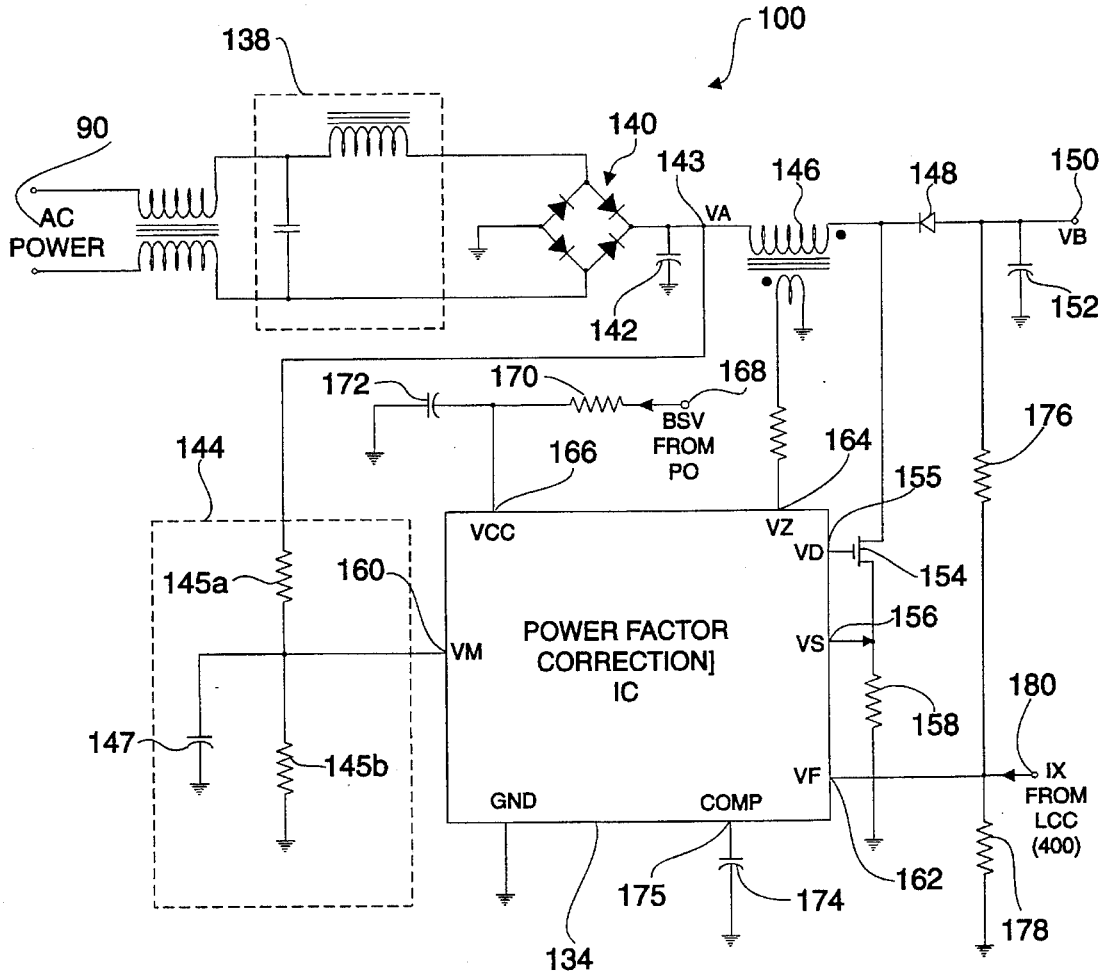
FIG. 3 is a schematic diagram of the preferred embodiment of the power-factor correction circuit shown in FIG. 2.

Referring also to FIG. 3, there is shown a schematic diagram of the power factor control circuit 100 (FIG. 2) in greater detail. A boost-type switching regulator is provided. This circuit has the capability to draw current from the AC waveform, even during those time intervals when the AC supply 90 is at low voltage levels of its sinusoidal waveform. The current is drawn proportional to the AC voltage waveform, so that the load appears resistive to the supply mains, ensuring a high power factor.

With the example herein described, power factors of approximately 98–99% can be achieved easily, compared to conventional, filtered, AC rectifier bridge circuits, for which power factors of 60% are typical. This present circuit is feasible due to a low-cost integrated circuit (IC) 134, which allows implementation of the control mechanism in a low-cost package. The preferred embodiment of circuit 100 is based on the Motorola Model No. MC32462 IC 134, although similar results may be obtained with other available PFC ICs, such as the Siemens Model No. TDA4817 IC or MicroLinear Model No. ML4812 IC.

Although a boost-type PFC is disclosed as the preferred embodiment, it should be understood that other power factor correction topologies are possible. For example, a MicroLinear Model No. ML4813 IC implements a buck-boost circuit. This approach could be used in situations in which the DC output voltage level is below the peak value of the AC line waveform, as might happen with ballasts operating from line voltages in excess of 220 volts rms.

AC power input 90 is conditioned by a radio-frequency interference (RFI) filter 138 and full wave rectified by a bridge rectifier configuration 140. A pulsating DC output voltage (VA) 143 is filtered by a capacitor 142. A fraction of this voltage VA 143 is sampled by a network 144 (consisting of resistors 145*a*, 145*b* and filter capacitor 147) and fed to a voltage multiplier input VM 160 of integrated circuit 134. Transformer 146 and diode 148 are connected in series to provide the boosted voltage output (VB) 150, which is filtered by a capacitor 152. A MOSFET transistor 154 is switched on and off under the control of drive voltage VD 155 from IC 134. The arrangement of transistor 154, transformer 146 and diode 148 forms a boost-switching power supply topology that is well known in the art. Switching transistor 154 on for a given duration causes a ramp of current to build up in transformer 146. When transistor 154 is switched off, current continues to flow at a boosted voltage through diode 148 and into capacitor 152.

The current which charges transformer 146 with magnetic energy is monitored by the current sense voltage (VS) 156 across a resistor 158. The voltage from this input is used by IC 134 to trigger transistor 154 off, when a predetermined level is reached. This level is determined within IC 134 and is proportional to the product of the sampled, pulsating DC voltage (VM) 160 and the deviation of the DC feedback voltage (VF) 162. Thus, the current that charges transformer 146 is proportional to the instantaneous AC voltage. Since many of these charge/discharge cycles occur during a power line cycle, the average current draw resembles that of a resistive load.

When transistor 154 is switched off, the current in transformer 146 decays in a linear fashion. The zero point of the current is sensed at the VZ 164 pin of IC 134 by a negative-going voltage transition of the secondary voltage of transformer 146. This transition begins the next boost cycle. The voltage supply for IC 134 is (VCC) 166; it is also obtained from the bias voltage (BSV) 168 of the PO circuit 200 (FIG. 4) by a resistor 170 and filter capacitor 172. Frequency compensation of the operational amplifier (not shown), internal to IC 134, is provided by a capacitor 174 connected to a COMP pin 175.

The DC output level is set by the voltage divider network of resistors 176 and 178. The control system (not shown), internal to IC 134, acts to keep the boosted output voltage (VB) 150 at a level so that the divided voltage at pin VF 162 is equal to the value of an internal reference voltage (VR) (not shown). For the Motorola Model No. MC32462 IC, the (VR) is typically 2.5 volts. Feedback current (IX) 180 from the lamp corrector circuit LCC 400 (FIG. 2) is used to modify the output voltage (VB) 150. The following expression for the boosted output voltage (VB) 150 follows from applying Kirchoff's circuit laws:

$$VB=VR\ (1+R_{176}/R_{178})-(IX\times R_{176})$$

For a typical ballast application, the output voltage (VB) 150 would be approximately 260 volts; the value of resistor 176 would be approximately 2940 ohms; and the value of resistor 178 would be approximately 301K ohms. For a 20% reduction in (VB) 150, the feedback current (IX) 180 required would be approximately 172 microamps.

Figure 4:
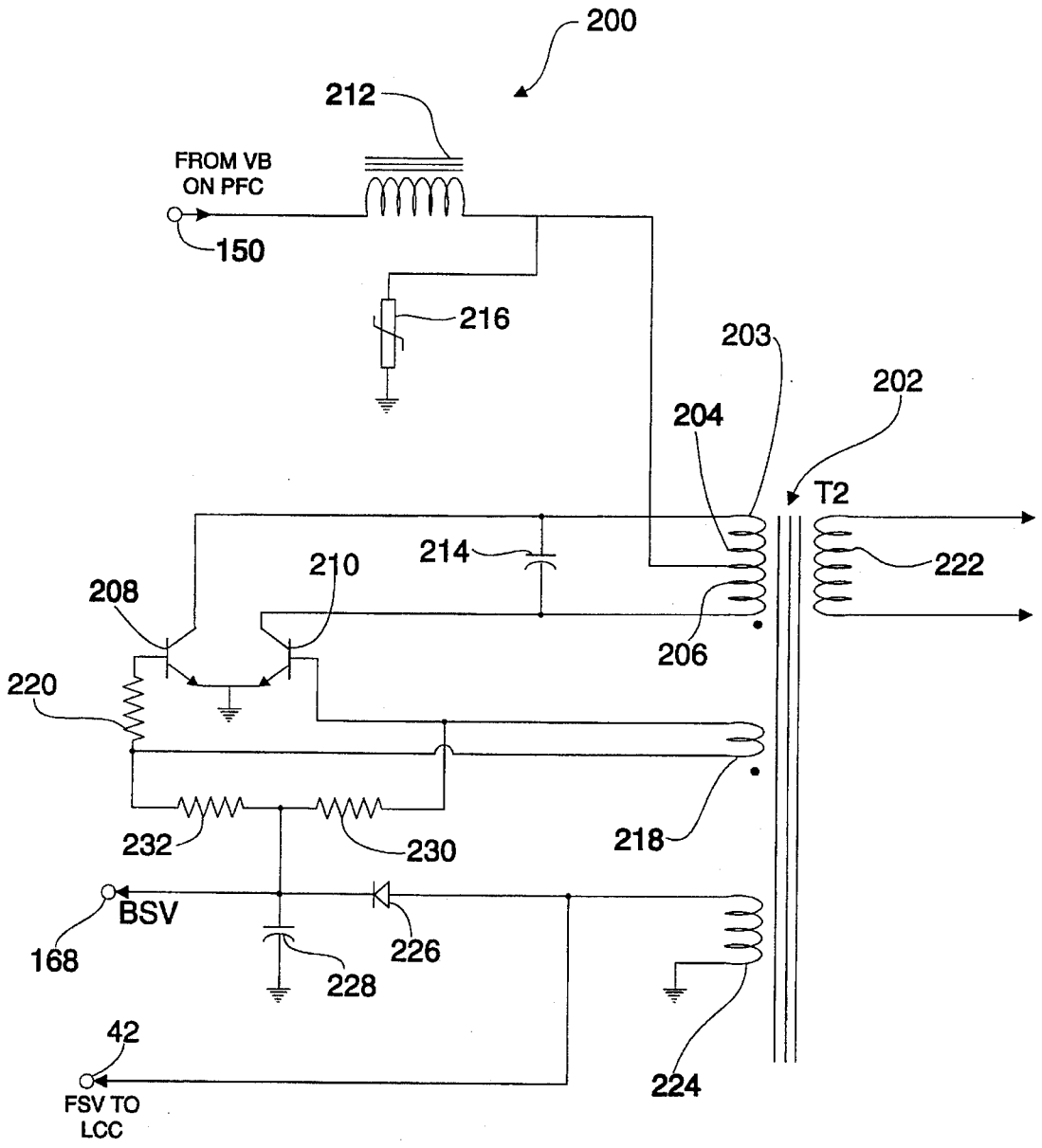
FIG. 4 is a schematic diagram of the preferred embodiment of the power oscillator circuit shown in FIG. 2.

Referring now also to FIG. 4, the power oscillator 200 (a Class D, resonant, push-pull inverter) is shown schematically in greater detail. Power oscillator circuit 200 is the preferred choice for the higher-powered ballasts because of its inherent simplicity and reliability. It is also a well-established circuit, described in detail, for example, in the 1959 British publication, *Proceedings of the IEE*, Volume 106 part B, pp. 748–758, in an article entitled, "Transistor Sine-Wave LC Oscillators", by P J Baxandall It is also discussed in depth in *Proceedings of the IEE*, Volume 106, part B, pp. 1373–1383 (1959), in an article entitled, "Practical Design Problems in Transistor DC/DC Converters and DC/AC Inverters", by T. D. Towers.

A key component of this power oscillation circuit 200 is the high-frequency transformer 202. The primary winding 203 of this transformer 202 is center-tapped, with the two halves being labelled as reference numerals 204 and 206, respectively. Each half 204 or 206 of primary winding 203 is connected to the collector of one of the bipolar power transistors 208 and 210, respectively.

The center tap of primary winding 203 is connected to the DC supply voltage by means of an isolation choke 212. Capacitor 214, forms part of the resonating capacitance of the LC tank circuit that determines the oscillation frequency. A transient-suppressing varistor 216 protects transistors 208 and 210 from the transient voltages that may sometimes occur during the start-up of the oscillator (when the starting conditions may have charged choke 212 with excessive magnetic energy). The use of a transient-suppressing diode for this purpose is also well known in the art.

Feedback winding 218 of transformer 202 and series current-limiting resistor 220 provide base drive to transistors 208 and 210 in such a phase relation as to maintain push-pull oscillations by alternately turning on transistors 208 and 210. The resulting drive current through transformer 202 forces alternations of the magnetic field in the transformer 202 core. The output power of secondary winding 222 of transformer 202 is connected to the OCC 300*a* (FIG. 2). The voltage across winding 224 of transformer 202, rectified by diode 226 and filtered by capacitor 228, provides bias current for the base drive of transistors 208 and 210 through pull-up resistors 230 and 232, and also provides a frequency sense voltage (FSV) 42 for the LCC circuit 400.

Figure 5A:
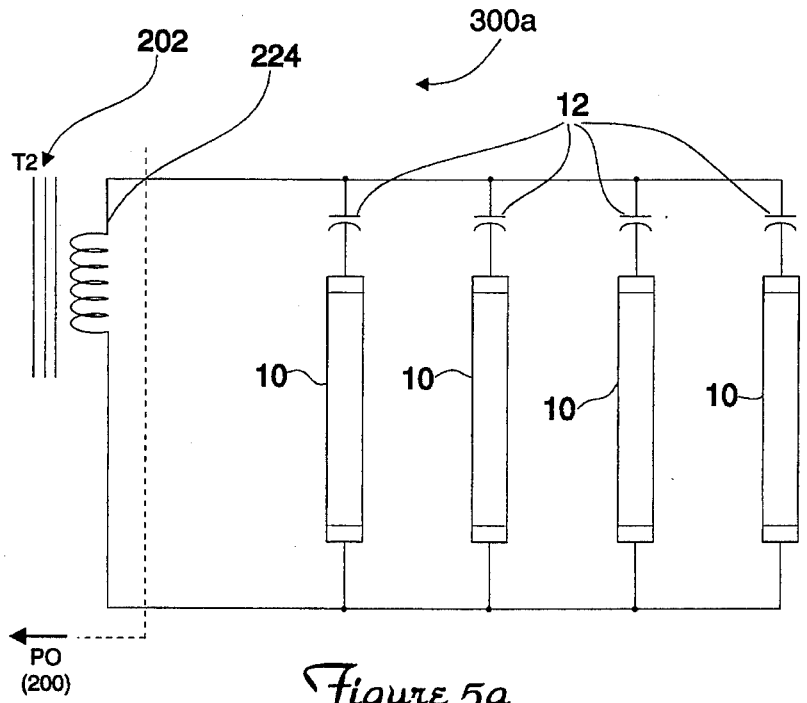
FIG. 5*a* is a schematic diagram of the output coupling circuit shown in FIG. 2, for use with a conventional configuration of gas discharge lamps connected in a parallel.

Referring now also to FIG. 5*a*, there is shown a schematic diagram of the preferred embodiment of an OCC circuit 300*a* in greater detail. The function of this circuit 300*a* is to couple the lamps 10 to the power oscillator 200, providing the proper source impedance so that a stable lamp discharge function is maintained, with the lamps 10 remaining in the glow discharge region while avoiding the arc region. Another function of this circuit 300*a* is to provide proper starting voltage to the lamps 10, so that the glow discharge can be reliably struck during start-up.

Because the current-voltage characteristics may vary from lamp to lamp 10, it is necessary to provide individual ballast capacitors 12 for each lamp in order to ensure that the current is equally distributed. The capacitors 12 used to ensure current sharing are the cause of the frequency shift that generally occurs upon removal of a lamp. FIG. 5*a* shows the connection of the ballast capacitors 12 for a standard, non-step dimmable ballast.

Figure 5B:
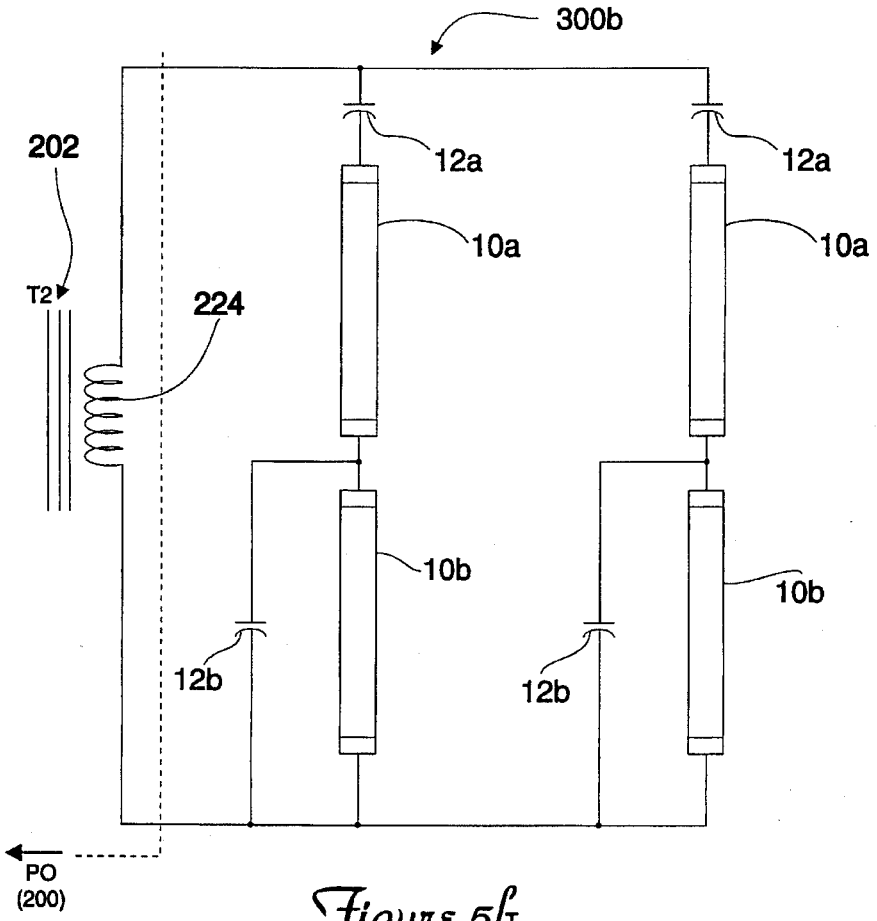
FIG. 5*b* is a schematic diagram of the output coupling circuit shown in FIG. 2, for use with a series-parallel configuration of gas discharge lamps.
Figure 5C:
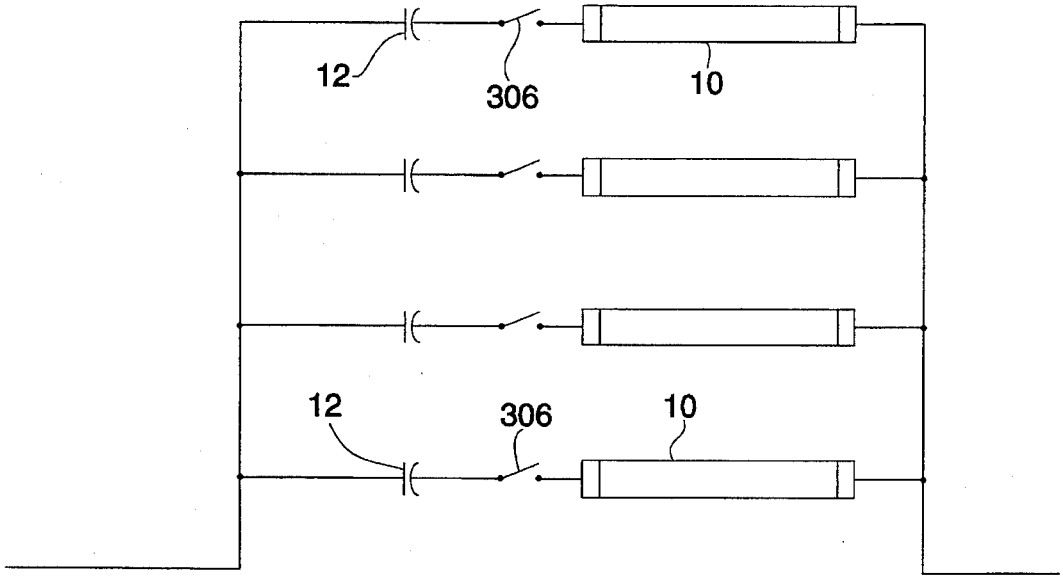
FIG. 5*c* is a schematic diagram of a circuit for selectively energizing gas discharge lamps.

Another configuration of output coupling circuit is shown in FIG. 5*b*. In this arrangement, pairs of lamps 10*a* and 10*b* are connected in series. The series-connected pairs are then placed in parallel across the secondary 224 of the transformer 202 by means of ballast capacitors 12*a*. This arrangement is valid for either the instant-start lamps shown in FIG. 5*b*, or for conventional, rapid-start lamps which require filament connections.

Referring still to FIG. 5*b*, starting capacitors 12*b* are used to initiate glow discharge of the lamps 10*b*. During the starting cycle, the lamps 10*b* are essentially open circuits. Starting capacitors 12*b* provide a shunt path for the starting current of the upper lamps 10*a*, so that their discharge strikes first. Since the resistance of the upper lamps 10*a* decreases as their discharge strengthens, increased current flows through capacitors 12*b* until sufficient voltage appears across the terminals of the lower lamps 10*b*, so that their discharge is struck. At full operating current, the low resistance of the lower lamps 10*b* shunt the capacitors 12*b*, effectively removing them from the circuit. The correcting property of the LCC circuit 400 (FIG. 2) is now exploited, if either of the paired strings of lamps 10*a* and 10*b* is removed or disconnected. When a pair is removed, the capacitance of circuit 300*b* increases, causing an increase in operating frequency and an increase in the current of the remaining pair of lamps 10*b* and 10*a*.

Figure 6A:
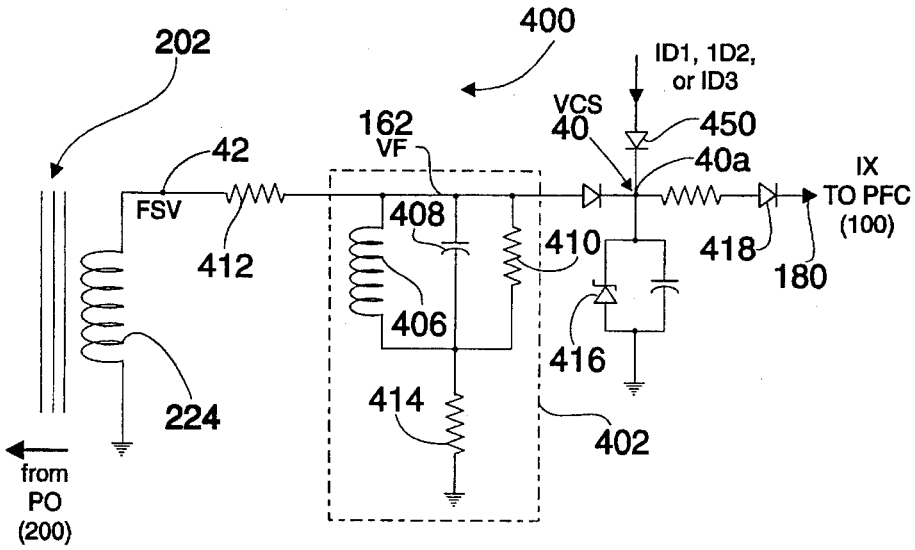
FIG. 6*a* is a schematic diagram of the preferred embodiment of the current correction circuit for lamps, as shown in FIG. 2.

Referring now also to FIG. 6*a*, there is shown a schematic diagram of the LCC 400 in greater detail. In this circuit, a high-frequency voltage sample (FSV) 42, obtained from the PO 200 (FIG. 2), is divided to a lower voltage level by a frequency-dependent divider network 402. The voltage level of this voltage sample 42 is relatively constant with frequency, but varies with the DC bus voltage VB 150. The voltage division of the divider network 402 tracks the increase in lamp current with increasing oscillator frequency, so as to form an analog representation of the lamp current without having sampled the lamp current directly. This divided voltage is then rectified and filtered to form the (VCS) signal 40, which, in turn, forces the control current (IX) 180 (FIG. 3) that is coupled back to the PFC 100 (FIG. 3). The control current IX 180 is then mixed with the feedback current that is used to regulate the boosted DC output level (VB) 150 (FIG. 3) of the PFC 100 (FIG. 3).

With the judicious selection of component values, changes in the DC level VB 150 can be induced, so as to cause the lamp current to remain essentially constant, regardless of the number of lamps 10 (FIG. 2) connected.

This circuit configuration may easily be modified to included a dimming network. The DC level (VB) 150 can be reduced by external means such as a switch, potentiometer, photo device, or motion detector. Reducing (VB) 150 (FIG. 3) causes the lamp current to decrease thereby reducing the brightness of the lamps 10.

The DC voltage control signal (VCS) 40 is formed by rectifying and filtering AC voltage (VF) 162, the divided version of frequency sense voltage (FSV) 42. The division ratio is frequency-dependent through a parallel resonant LCR circuit formed from inductor 406, capacitor 408 and resistor 410, in conjunction with a series resistor 412. This division ratio can be calculated by one skilled in the art using Kirchoff's circuit laws. For situations where the loading by the control current (IX) 180 (FIG. 3) is small, the voltage division ratio is:

$$VF/FSV=Z/(R_{412}+Z)$$

In this equation, the AC impedance Z is the impedance of the parallel resonant circuit 402. For use in the LCC 400, the resonant frequency, where Z is a maximum and equal to resistor 410, is set approximately to the highest frequency of interest (that of the operating frequency of the inverter, when one lamp 10 is operating). A resistor 414 is connected between capacitor 408 and the ground to allow flexibility in setting the low and high limits of (VCS) signal 40.

Component values are selected so that the rectified voltage (VCS) 40 is equal to the clamping voltage of zener diode 416 at the highest operating frequency (where the VCS is the highest). At the lowest frequency of operation, component values are chosen so that the VCS 40 falls below the threshold of the conduction of IX 180 (FIG. 3) through diode 418. Then, the LCC 400 exhibits no influence on the PFC 100, and that circuit operates as a standard power factor corrected ballast. This threshold voltage at which LCC 400 becomes active is approximately one diode forward voltage drop (approximately 0.5–0.6 volts) above the internal reference voltage of the power factor correction chip IC 134. For the Motorola Model No. MC34262 IC, which has an internal voltage reference value of 2.5 volts, this threshold voltage is approximately 3.0–3.1 volts.

In the LCC 400, a diode 418 serves to isolate the sensitive input of the power-factor IC 134 error amplifier from the VCS 40, when the latter falls below the internal reference voltage. If this were to happen when diode 418 were not present, current IX 180 would reverse in direction, and VB 150 could rise to excessive levels, possible damaging the ballast. Similarly, a zener diode 416 serves to clamp VCS 40 at a predetermined, maximum level, so that the current IX 180 (FIG. 3) does not become excessive.

Figure 6B:
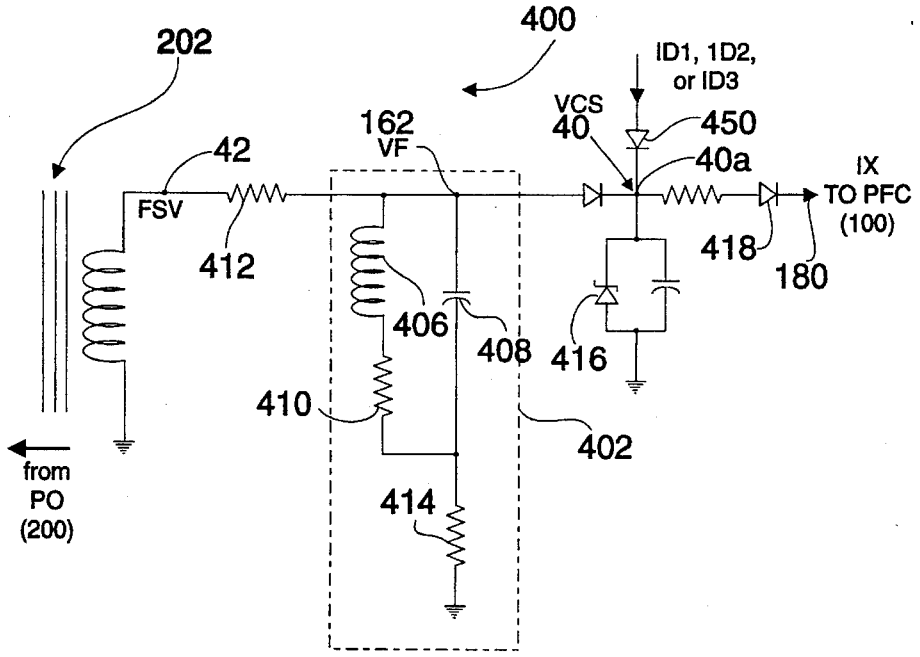
FIG. 6*b* is a schematic diagram of an alternate embodiment of the current correction circuit for lamps, as shown in FIG. 2.

FIG. 6*b* shows an alternative embodiment of the LCC circuit of FIG. 6*a*. In this embodiment the frequency-dependent divider network 402 has been modified. Resistor 410 of FIG. 6*a* acts as a damping resistor to resonant circuit 402 and serves to partially determine its frequency-dependent characteristics. In the embodiment of FIG. 6*b*, resistor 410 has been placed in series with resonating inductor 406, where it also acts in a damping capacity. This placement of resistor 410 can result in a higher VF 162 and a modified frequency response characteristic.

Figure 7C:
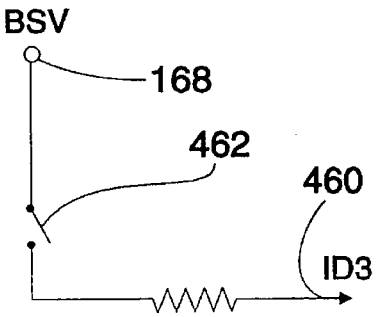
FIG. 7*c* is a schematic diagram of a circuit for providing an external dimming signal utilizing a switch.
Figure 7B:
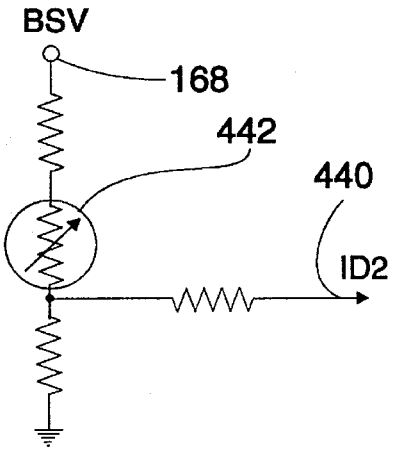
FIG. 7*b* is a schematic diagram of a circuit for providing an external dimming signal utilizing a photoresistor.
Figure 7A:
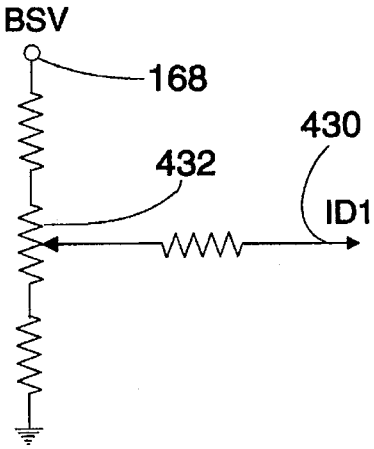
FIG. 7*a* is a schematic diagram of a circuit for providing an external dimming signal utilizing a potentiometer.

Referring now to FIGS. 7*a*, 7*b* and 7*c*, there are shown three circuits that can be used for dimming over a limited range in order to conserve electrical power. These circuits each create a dimming control current ID1 430, ID2 440, or ID3 460 for injection into diode 450. Diode 450 prevents a reverse current from flowing out of the VCS node 40*a* that could shunt the frequency control signal and reduce its controlling effect.

The dimming circuits inject either a current ID1 430 controlled by a potentiometer 432, (FIG. 7*a*), or a current ID2 440 controlled by a photoresistor 442 (FIG. 7*b*), or a current ID3 460 controlled by switch 462 (FIG. 7*c*), into diode 450. If the ambient light increases in value, the resistance of photoresistor 442 decreases and it becomes more conductive. This causes an increase in current ID2 440 and, consequently, IX 180, which reduces the DC output voltage VB 150. Diodes 450, 418 and 416 maintain the same protective roles as described hereinabove. With proper choice of component values, a reduction in DC power level of approximately 20% can be achieved. Switch 462 (FIG. 7*c*) may be located on or near the ballast so that the user may optionally reduce the power output of the ballast.

Figure 8:
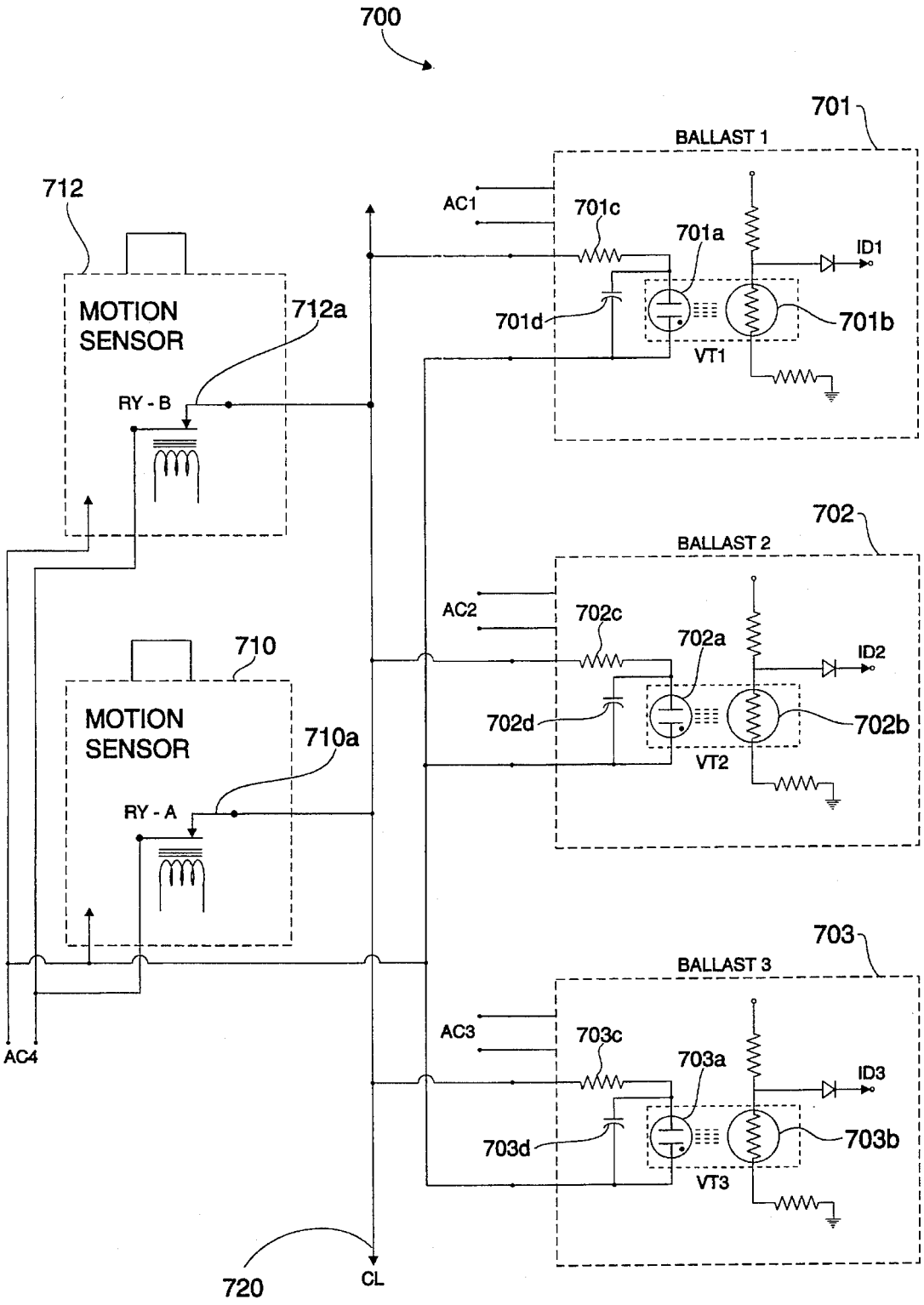
FIG. 8 is a schematic diagram of a lighting system, in accordance with the present invention, that incorporates motion detection systems.

Referring now to FIG. 8, there is shown a schematic diagram of a lighting system 700 in which a plurality of ballasts 701, 702 and 703 is connected for dimming, under the control of either one or a number of motion detector systems. Motion detectors (sensors) 710 and 712 are connected, as shown. Typical motion sensors 710 and 712 are manufactured by the Hubbell Company (Model No. WSS13000) and the Pass & Seymour Company (Model No. DSC 3000-1). If any motion in the room is detected by sensor 710 or 712 internal relay 710*a* or 712*a* closes, energizing control line CL 720 with AC line voltage. If motion is not found by any sensor 710 or 712, no voltage is present on CL 720. The control line CL 720 is connected in parallel to all ballasts 701, 702 and 703.

Vactrol devices are standard electronic isolating components, such as those manufactured by the EG&G Vactec Company (Model No. VTL110). Vactrol or other similar isolating devices, such as relays or opto-isolators, are necessary because the internal ground of the ballast is not at the same electrical potential as the AC neutral conductor, and a direct connection could cause a short circuit. In addition, adjoining ballasts may be connected to differing phases of a three-phase power distribution network, and AC inputs AC1, AC2, AC3 and AC4 may differ from one another. Thus, complete AC isolation between devices is required.

When energized from motion detected in the room, neon lamp 701*a*, 702*a* or 703*a* (internal to Vactrol devices VT1, VT2 or VT3, respectively) becomes active, causing the Vactrol photoresistor 701*b*, 702*b* or 703*b* to become conductive. Because of the shunt connection, dimming current ID1, ID2 or ID3 is switched to ground, and the lamps then attain full brightness.

Consequently, if any motion is detected within the sensed area of a room, the lamps operate at normal brightness. However, if no motion is detected after a predetermined period of time (set within the motion detector circuit), internal relays 710*a* and 712*a* de-energize line CL 720 and the lamps dim, thereby conserving energy. Within the ballast, current-limiting resistors 701*c*, 702*c* or 703*c* is required in the feed to the neon lamp 701*a*, 702*a* or 703*a*. A small capacitor 701*d*, 702*d* or 703*d* across the neon lamp is required for low-pass filtering so that stray electrical pickup does not fire the respective neon lamp 701*a*, 702*a* or 703*a*. (Possible sources of stray AC voltage include either the high-frequency lamp voltage applied to the fluorescent lamp or nearby 60 Hz wiring.)

Ballasts 701, 702 and 703 can be designed in which motion detector circuits 710 or 712 are internally located within their respective ballasts and produce a dimming current when an absence of motion is detected for a predetermined time. Sensors 710 or 712 are located either on the case of their respective ballasts 701, 702 or 703, or on the lamp fixture 10 and connected by means of a short cable (not shown). Motion detection circuits are well known within the electronic art. Such circuits are described in Chapter 55 of the *Encyclopedia of Electronic Circuits*, by Rudolf F. Graf and William Sheets, Volume 4, 1992, McGraw-Hill Co.

Instant-start, rapid-start and preheat-start lamps are well known in the art. It should be understood that, although instant-start lamps are referred to for purposes of disclosure, the inventive concept is also valid for ballasts that use rapid-start and preheat-start lamps, and which include filament circuitry. Such filament circuitry is well known to those skilled in the art and its inclusion in alternate embodiments does not constitute a departure from the scope of this invention.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be covered by Letters Patent is presented in the subsequently appended claims.

What is claimed is:

1. An AC line-powered electronic ballast for use with gas discharge lamps, comprising:

a) a power supply having a predetermined power factor and a DC output voltage, and controlling means therefor;

b) a power oscillator having a predetermined operating frequency, said power oscillator being operatively connected to said power supply for providing a high-frequency AC output voltage;

c) an output coupling circuit operatively connected to said power oscillator for providing a lamp voltage, representative of said AC output voltage, to a gas discharge lamp;

d) a frequency-dependent feedback circuit operatively connected to said power supply, to said power oscillator, and to said output coupling circuit to monitor said AC output voltage and power oscillator operating frequency, and to apply a control signal to said power supply to control said DC output voltage, said control signal being a function of said power oscillator operation frequency, whereby lamp current is maintained at a substantially constant level as the number of gas discharge lamps is changed.

2. The AC line-powered electronic ballast for use with gas discharge lamps as recited in claim 1, wherein said output coupling circuit comprises a reactive element for controlling current to gas discharge lamps.

3. The AC line-powered electronic ballast for use with gas discharge lamps as recited in claim 2, wherein said reactive element comprises a capacitor.

4. The AC line-powered electronic ballast for use with gas discharge lamps as recited in claim 1, wherein said power supply comprises an electronically regulated power supply.

5. The AC line-powered electronic ballast for use with gas discharge lamps as recited in claim 1, wherein said feedback circuit comprises a frequency-to-voltage converter.

6. The AC line-powered electronic ballast for use with gas discharge lamps as recited in claim 5, wherein said signal representative of said AC output voltage is further representative of said operating frequency.

7. The AC-line powered electronic ballast for use with gas discharge lamps as recited in claim 1, further comprising:

e) means operatively connected to said power supply for correcting said predetermined power factor.

8. The AC line-powered electronic ballast for use with gas discharge lamps as recited in claim 7, wherein said means for correcting said power factor comprises an integrated circuit chip.

9. The AC line-powered electronic ballast for use with gas discharge lamps as recited in claim 7, wherein said predetermined power factor is corrected to a value greater than 0.90.

10. The AC line-powered electronic ballast for use with gas discharge lamps as recited in claim 9, wherein said predetermined power factor is corrected substantially to unity.

11. The AC line-powered electronic ballast for use with gas discharge lamps as recited in claim 1, further comprising:

f) an externally-generated signal applied, with said feedback signal, to said feedback circuit, to control said DC output voltage of said power supply.

12. The AC line-powered electronic ballast for use with gas discharge lamps as recited in claim 11, wherein said externally-generated signal is controlled by a switch proximate the electronic ballast.

13. The AC line-powered electronic ballast for use with gas discharge lamps as recited in claim 11, wherein said externally-generated signal comprises a signal from a potentiometer.

14. The AC line-powered electronic ballast for use with gas discharge lamps as recited in claim 11, wherein said externally-generated signal comprises a signal representative of an ambient light level.

15. The AC line-powered electronic ballast for use with gas discharge lamps as recited in claim 11, wherein said externally-generated signal comprises a motion detecting signal.

16. The AC line-powered electronic ballast for use with gas discharge lamps as recited in claim 15, wherein said motion detecting signal comprises a time-delayed motion detecting signal.

17. An AC line-powered electronic ballast for use with a multiplicity of gas discharge lamps, comprising:

a) a power supply having a predetermined power factor and a DC output voltage, and controlling means therefor;

b) a power oscillator having a predetermined operating frequency, said power oscillator being operatively connected to said power supply for providing a high-frequency AC output voltage;

c) an output coupling circuit operatively connected to said power oscillator for providing a lamp voltage, representative of said AC output voltage, to at least one of a multiplicity of gas discharge lamps;

d) a feedback circuit operatively connected to said power supply, to said power oscillator, and to said output coupling circuit to monitor said AC output voltage, and to apply a signal representative thereof to said power supply to control said DC output voltage; and e) motion detecting means operatively connected to said output coupling circuit for providing a motion detection signal for selectively energizing said gas discharge lamps.

18. The AC line-powered electronic ballast for use with gas discharge lamps as recited in claim 17, wherein said means for selectively energizing individual gas discharge lamps comprises a relay.

19. The AC line-powered electronic ballast for use with gas discharge lamps as recited in claim 17, wherein said means for selectively energizing individual gas discharge lamps comprises a semiconductor switching device.

20. The AC line-powered electronic ballast for use with gas discharge lamps as recited in claim 17 wherein said motion detecting signal is time-delayed.

21. An AC line-powered, electronic ballast for use with a multiplicity of gas discharge lamps, each of which is connected with its ballast capacitor in parallel with one another across the output of the power oscillator of said electronic ballast, comprising:

a) electronically regulated power supply means for providing a DC output voltage, said power supply means having means adapted for controlling said output voltage, and said electronically regulated power supply means having a predetermined power factor and means for correction thereof;

b) a power oscillator having a predetermined operating frequency, said power oscillator being operatively connected to said power supply means and said multiplicity of gas discharge lamps for providing a high-frequency AC output voltage at a level dependent upon said DC output voltage;

c) an output coupling circuit operatively connected to said power oscillator for applying a portion of said AC output voltage to a gas discharge lamp; and d) frequency-dependent feedback means operatively connected to said output coupling circuit, to said power oscillator, and to said power supply means to monitor said AC output voltage and said predetermined operating frequency, said feedback means providing a feedback signal to said power supply means to control said DC output voltage, such that gas discharge lamp current is maintained within a predetermined range, irrespective of how many gas discharge lamps are connected to said power oscillator, or whether at least one gas discharge lamp of said multiplicity of gas discharge lamps is removed from said power oscillator.

22. The AC line-powered electronic ballast for use with gas discharge tubes as recited in claim 21, wherein said feedback signal is representative of said AC output voltage.

23. The AC line-powered electronic ballast for use with gas discharge tubes as recited in claim 22, wherein said feedback signal is further representative of said predetermined operating frequency.

24. An AC line-powered electronic ballast for use with a multiplicity of gas discharge lamps, comprising:

a) a power supply having a predetermined power factor and a DC output voltage, and controlling means therefor;

b) a power oscillator having a predetermined operating frequency, said power oscillator being operatively connected to said power supply for providing a high-frequency AC output voltage;

c) an output coupling circuit operatively connected to said power oscillator for providing a lamp voltage, representative of said AC output voltage, to at least one of a multiplicity of gas discharge lamps;

d) a feedback circuit operatively connected to said power supply, to said power oscillator, and to said output coupling circuit to monitor said AC output voltage, and to apply a signal representative thereof to said power supply to control said DC output voltage; and e) light sensor means operatively coupled to said output coupling circuit for providing a signal for selectively energizing at least one of said multiplicity of gas discharge lamps, said signal being representative of an ambient light level.

* * * * *